US006931815B2

(12) United States Patent
Plüschow

(10) Patent No.: US 6,931,815 B2
(45) Date of Patent: Aug. 23, 2005

(54) MACHINE FOR PACKAGING A PRODUCT WITH A PAMPHLET

(75) Inventor: Dieter Plüschow, Stutensee (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 10/483,717

(22) PCT Filed: Apr. 4, 2003

(86) PCT No.: PCT/EP03/03528

§ 371 (c)(1),
(2), (4) Date: Jan. 14, 2004

(87) PCT Pub. No.: WO03/099662

PCT Pub. Date: Dec. 4, 2003

(65) Prior Publication Data

US 2005/0115199 A1 Jun. 2, 2005

(30) Foreign Application Priority Data

May 24, 2002 (DE) ..... 102 23 066

(51) Int. Cl.[7] ..... B65B 35/54
(52) U.S. Cl. ..... 53/55; 53/157; 53/154; 53/237; 53/244; 53/249; 53/251
(58) Field of Search ..... 53/157, 154, 55, 53/237, 202, 244, 247, 255

(56) References Cited

U.S. PATENT DOCUMENTS 4,502,262 A * 3/1985 Reim et al. ..... 53/157
4,903,461 A * 2/1990 Dimur ..... 53/569
5,463,840 A 11/1995 Bailer
6,354,060 B1 * 3/2002 Pluschow et al. ..... 53/157
6,637,174 B1 * 10/2003 Dietrich et al. ..... 53/252
2004/0020164 A1 * 2/2004 Dharssi et al. ..... 53/54
2004/0163361 A1 * 8/2004 Herkel ..... 53/499

FOREIGN PATENT DOCUMENTS

| | | |
|---|---|---|
| DE | 30 40 866 | 6/1982 |
| DE | 199 18 527 | 10/2000 |
| EP | 0 588 772 | 3/1994 |
| EP | 0 957 028 | 11/1999 |
| EP | 1 050 472 | 11/2000 |

* cited by examiner

*Primary Examiner*—Rinaldi I. Rada
*Assistant Examiner*—Brian Nash
(74) *Attorney, Agent, or Firm*—Paul Vincent

(57) ABSTRACT

A packaging machine comprises a transfer device for inserting a product into a package and a circulating leaflet supply device comprising a plurality of tong-like holders which are sequentially disposed, each for receiving one leaflet and for bringing that leaflet into a region of the transfer device between the product and the package such that it can be inserted together with the product into the package. An opening unit with several stops, which can be actuated independently of each other, is disposed in the transport path of the holders for opening the holders to release the leaflet. The stops can be brought into an inoperative position in which the holders pass by the stops without releasing the leaflet. In this connection, the leaflet supply device comprises first holders to be opened by a first stop, and second holders to be opened by a second stop, and successive, sequential holders cooperate with and can be opened by different stops.

10 Claims, 2 Drawing Sheets

MACHINE FOR PACKAGING A PRODUCT WITH A PAMPHLET

This application is the national stage of PCT/EP03/03528 filed on Apr. 4, 2003 and also claims Paris Convention priority of DE 102 23 066.8 filed May 24, 2002.

BACKGROUND OF THE INVENTION

The invention concerns a packaging machine having a transfer device for inserting a product into a package, and with a circulating leaflet supply device comprising a plurality of tong-like holders which are disposed in a row, each for receiving one leaflet, the leaflet supply device disposing the leaflet in the region of the transfer device between the product and the package such that the leaflet can be inserted together with the product into the package, wherein an opening unit, comprising several stops which can be actuated separately, is disposed in the transport path of the holders to open the holders for releasing the leaflet, wherein the stops can be brought into a non-operative position in which the holder passes the stops without releasing the leaflet.

A packaging machine of this type usually has a first circulating supply device for the package, e.g. a so-called folded box chain, and a second circulating supply device for the products, e.g. a so-called product chain. The motions of these two chains are synchronized such that the product can be laterally inserted into the folded box by an insertion plunger, transversely to the direction of motion of the chains. For certain products, e.g. medication, an additional leaflet or side note must be inserted into the package. For this reason, one further circulating supply device is provided which supports several tong-like holders each of which can receive and clamp one leaflet. A leaflet to be inserted into the package is positioned in the supply device between the product and the folded box and is carried along by the product through its lateral inserting motion to be inserted into the folded box. As soon as the product abuts the leaflet, the tong-like holder must be opened to release the leaflet. Towards this end, an opening unit is provided in the region of the transfer device, e.g. in the form of a stop or opening wedge, against which the tong-like holder abuts during its supply motion thereby opening the tong arms and releasing the leaflet.

Small irregularities may occur during operation of the packaging machine. The folded boxes may thereby be supplied to the folded box chain or the products supplied to the product chain in a discontinuous fashion such that either one or more sections of the folded box chain have no folded box or one or more sections of the product chain contain no product. A sensor detects when a folded box or a product is missing such that the insertion plunger is not activated and no product is inserted.

In older packaging machines, the stop is rigidly installed and the tong-like holder also opens when no product is being inserted into a folded box. It has turned out that the leaflet released in this case, can move randomly through the packaging machine and cause malfunction as well as temporary stoppage, which requires time-consuming and expensive manual intervention. To solve this problem, DE 199 18 527 A1 proposes bringing the opening wedge out of the transport path of the tong-like holder into an inoperative position, when required. In this fashion, the tong-like holder opens and releases the leaflet only when a folded box is actually present in the folded box chain and the product chain contains a product. When no folded box or no product is present, the opening wedge is removed from the transport path of the tong-like holders such that the tong-like holder with leaflet passes the stop and is not opened thereby. The stop then returns into its operative position to open the next tong-like holder if the conditions required therefor are met.

In a modern packaging machine, the amount of time required for one working cycle is only a few milliseconds. During this time, the conditions required for adjusting the stop, at least with regard to the product and the package, must be detected and evaluated and the operating means must be activated to adjust the stop. To ensure safe removal of the leaflet from the tong-like holder during insertion of the product, the tong-like holder must be kept open by the stop for a sufficient period of time. This required period of time is usually longer than the working cycle of a rapidly working packaging machine. In this case, DE 199 18 527 A1 proposes a stop consisting of several stop elements disposed one behind the other in the transport direction of the tong-like holders, which can be adjusted independently of each other between the operative position and the inoperative position. The size of each stop element in the transport direction of the tong-like holders is thereby smaller than the mutual separation between successive holders such that each stop element can return to its operative position as soon as a holder which cannot be opened has passed it and before the next holder comes into the region of the stop element. It has turned out that, when the packaging machine works rapidly, the cycling times, i.e. the time between passage of successive tong-like holders and therefore successive leaflets, is too short to come to a decision concerning the opening or not opening of the tongs and to adjust the stops or the stop elements accordingly as well as to carry out the adjustment motion of the stops with sufficient precision when required.

It is the underlying purpose of the present invention to provide a packaging machine of the mentioned type with which sufficient time is provided for a precise adjustment motion of the stops.

SUMMARY OF THE INVENTION

This object is achieved in accordance with the invention with a packaging machine of the above-mentioned type in that the leaflet supply device has first holders which can be opened only by a first stop, and second holders which can be opened only by a second stop and that successive, sequential holders cooperate with different stops and can be opened thereby.

In the present case, one initially assumes that the leaflet supply device bears tong-like holders of two different designs, i.e. first holders and second holders. The first holders are associated with a first adjustable stop through which the first holders can be opened when the first stop is in its operative position and a first holder abuts against the first stop. A second adjustable stop is provided for the second holders which opens the second holders when located in its operative position and a second holder abuts against it. It is thereby essential in accordance with the invention that the first and second holders are disposed in alternating sequence on the leaflet supply device. In this fashion, e.g. the first holders have the first, third, fifth (etc.) position in the row of holders of the leaflet supply device while the second holders have the second, fourth, sixth (etc.) position. Each stop must be activated only in every second working cycle such that a sufficiently long time remains to ensure safe removal of the leaflet from the tong-like holder during insertion of the product as well as to obtain precise adjustment of the stop when required.

In this embodiment having first and second holders, two working cycles are available for detecting and processing the relevant status data and for adjusting the stops. If this time is not sufficient, in particular when the working cycle time is further reduced, a further development of the invention may provide that the leaflet supply device has additional third holders which can only be opened by a third stop. In this embodiment, the first, second and third holders would be placed on the leaflet supply device in this order and in repeated sequence such that every third holder of the row has a similar design and a period of three working cycles is provided for the detection and processing of relevant status data and for initiation and carrying out of the adjustment motion of the stops.

The stops are preferably designed as conventional stop parts or stop strips which are disposed one above the other, next to the leaflet supply device and which extend in the longitudinal direction thereof.

In a preferred embodiment of the invention, the stops are biased by springs into their inoperative position such that activation of a controllable actuating device is required to bring or keep a stop in the operative position against its spring bias as long as the conditions required for opening the tong-like holder and release of the leaflet are met. The actuating device may be a pneumatic or hydraulic adjustment cylinder. The stops can be adjusted and, in particular, displaced substantially perpendicular to the transport direction of the leaflet supply device.

To open a tong-like holder, a stop part thereof must come into contact with the associated stop. Since the transport speed in a rapidly working packaging machine is high, relatively large dynamic forces occur when the stop part of the holder abuts against the associated stop. To keep the internal loads produced thereby as small as possible, a further development of the invention provides that at least one roller is provided as a stop part of the holder, which comes into abutment with the stop and rolls thereon to avoid excessive frictional forces. In practice, it has turned out to be helpful to associate at least two parallel adjacent rollers with each stop part such that when the holder abuts against the stop, a larger surface is available to reduce loads.

During operation of a packaging machine, the plunger with which the product is inserted into the package is activated only when a product is present, when a leaflet is present having the right code, and when a package and folding box is present. The corresponding queries or detections are carried out in the packaging machine and the corresponding data is input to a data storage, a so-called shift register, and can be queried therefrom. This data also forms the basis for the decision as to whether or not the tong-like holder is opened to release the leaflet. To keep the data processing effort as small as possible, initiation of an opening motion of a tong-like holder is not effected directly by accessing the above-mentioned shift register data. In a further development of the invention, this data is used only indirectly by providing a first detector device by which the insertion motion of the product into the package is detected and a corresponding insertion signal is issued to a control device. An insertion motion of the product occurs only when the plunger is initiated, which again depends on observance of the above-mentioned conditions. When the first detector device determines that the plunger is moved to insert the product, the above-mentioned conditions must all be met. The insertion signal indicates whether or not the leaflet is to be released through opening of the associated tong-like holder.

In a preferred embodiment of the invention, a second detector device is also provided which detects the position and the structure of the next holder to be opened and transmits a corresponding holder signal to the control device. The second detector device thereby determines whether a holder has reached a predetermined position and whether the holder is of the first structure (first holder) which can be opened by the first stop, a second holder of the second structure (second holder) which can be opened by the second stop or, optionally, a holder of the third structure (third holder) which can be opened by the third stop.

The control device evaluates whether the tong-like holder is to be opened or remain closed on the basis of the received insertion signal and which of the stops can be brought into or be held in the operative position through enablement of the respective actuation device to open the holder determined by the second detector device. When the actuating device of the associated stop is not activated, the tong-like holder passes the opening unit without being opened. The leaflet is removed from the holder at another location of the leaflet supply device e.g. by a further stop and is discharged or disposed of in a suitable fashion.

To use and correspondingly adjust the packaging machine for products of different sizes, the first detector device, the second detector device and the opening unit, including all stops, can be adjusted as a unit in the transport direction of the leaflet supply device.

Further details and features of the invention can be extracted from the following description of an embodiment with reference to the drawing.

DESCRIPTION OF THE PREFERRED EMBODIMENT

Figure 1:
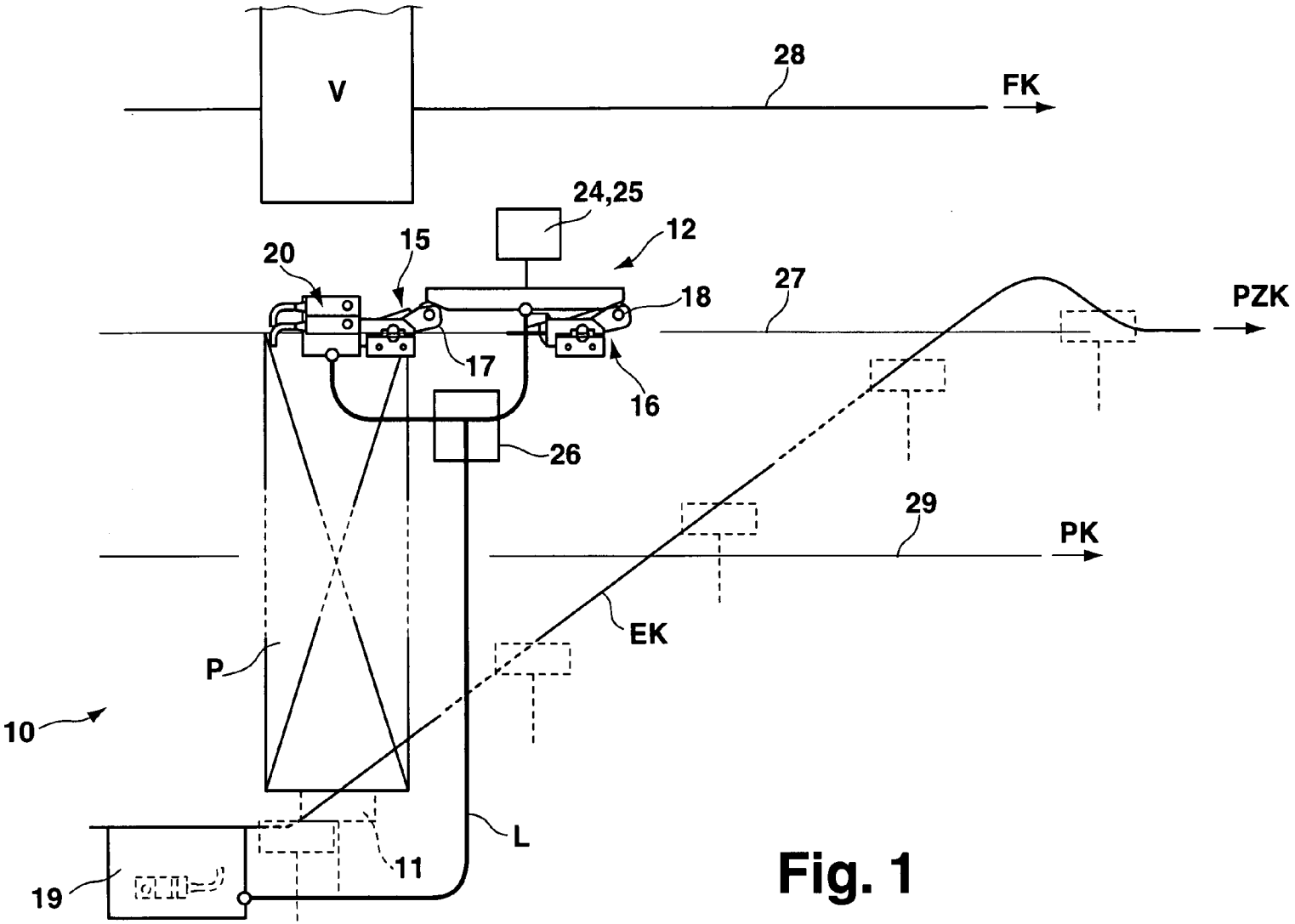
FIG. 1 shows a schematic representation of a transfer device in a packaging machine.

FIG. 1 schematically shows a transfer device 10 of a packaging machine which comprises a folding box chain 28 (only schematically shown) which extends in the direction of the arrow FK for receiving folding boxes or packages V and a product chain 29 extending parallel thereto in the direction of the arrow PK which receives products P to be packaged. To facilitate the illustration, FIG. 1 shows only one package V and one product P. The motions of the folding box chain 28 and the product chain 29 are synchronized such that the product P can be inserted into the open package V by a plunger 11 in the transfer device 10 and transverse to the direction of motion of the chains 28, 29. The plunger 11 thereby follows an insertion curve EK.

A circulating leaflet tong chain 27 (transport path PZK) extends between (below and parallel to) the folding box chain 28 and product chain 29 and carries, at regular intervals, a plurality of tong-like holders 15, 16 between the jaws of which one leaflet 22, 23 (see FIG. 2) can be clamped in an upright position. The leaflet 22, 23 is guided such that it is disposed between the package V and the product P in the region of the transfer device and, when the product P is laterally inserted into the package V, it is carried along by the product and inserted into the package V. The holder 15, 16 clamping the leaflet 22, 23 must be opened when the leaflet 22, 23 is inserted into the package V. Towards this end, the transfer device 10 has an opening unit 12 comprising two independent opening devices which are each structured as adjustable stops 13 and 14. The stops are disposed one above the other and extend parallel to the transport path PZK of the leaflet tong chain 27 and of the tong-like holders 15, 16. Each stop 13, 14 has an associated actuating device 24, 25 with which the stops 13, 14 can be adjusted substantially perpendicular to the transport path PZK of the tong-like holders 15, 16, between an operative position and a withdrawn inoperative position. Each stop 13, 14 is thereby pretensioned into its inoperative position by a spring.

Tong-like holders of different construction are mounted to the leaflet tong chain 27. All holders have conventional clamping jaws or tongs to clamp the leaflet 22 or 23. Moreover, each holder has an axis 30 which extends transverse to the transport path PZK on each of which two rollers 17*a* and 18*a* are rotatably disposed to form the stop part of the holder 15 or 16. The holders 15, 16 differ with regard to arrangement and orientation of their stop parts 17, 18 and rollers 17*a*, 18*a*. The stop part 17 with rollers 17*a* of a tong-like holder of the first structure (first holder 15) is oriented such that it abuts against the stop 13 (first stop) when it is in its operative position. The second stop 14 is ineffective for the first holder 15. The stop part 18 of a holder of the second structure (second holder 16) is oriented with its rollers 18*a* such that they abut against the second stop 14 during passage of the opening unit 12 when the second stop 14 is in its operative position. The first stop 13 is ineffective for the second holder 16. The first and second holders 15 and 16 are alternately disposed on the leaflet tong chain 27, i.e. every second holder is a holder of the first structure, with a holder of the second structure being provided between each of them.

FIG. 1 shows that the plunger 11 has a first associated detector device 19 to detect whether the plunger 11 is displaced, thereby inserting the product P. The first detector device 19 transmits a corresponding insertion signal to a control device 26 via a data line L. Moreover, a second detector device 20 is provided close to the leaflet tong chain 27 before the opening unit 12 to determine that the next tong-like holder to be opened has obtained a predetermined position and to determine the structure of this holder, i.e. whether it is to be opened by the first stop 13 or the second stop 14 of the opening unit 12. The second detector device 20 transmits a corresponding holder signal to the control device 26. The signals are processed in the control device. When the first detector device 19 has determined that the product P is inserted, all required conditions for releasing the leaflet 22 or 23 from the tong-like holder 15, 16 are met. The control device 26 controls the actuating device 24, 25 of that stop 13, 14 which is associated with the next tong-like holder 15 to be opened as was determined by the second detector device 20.

Figure 2:
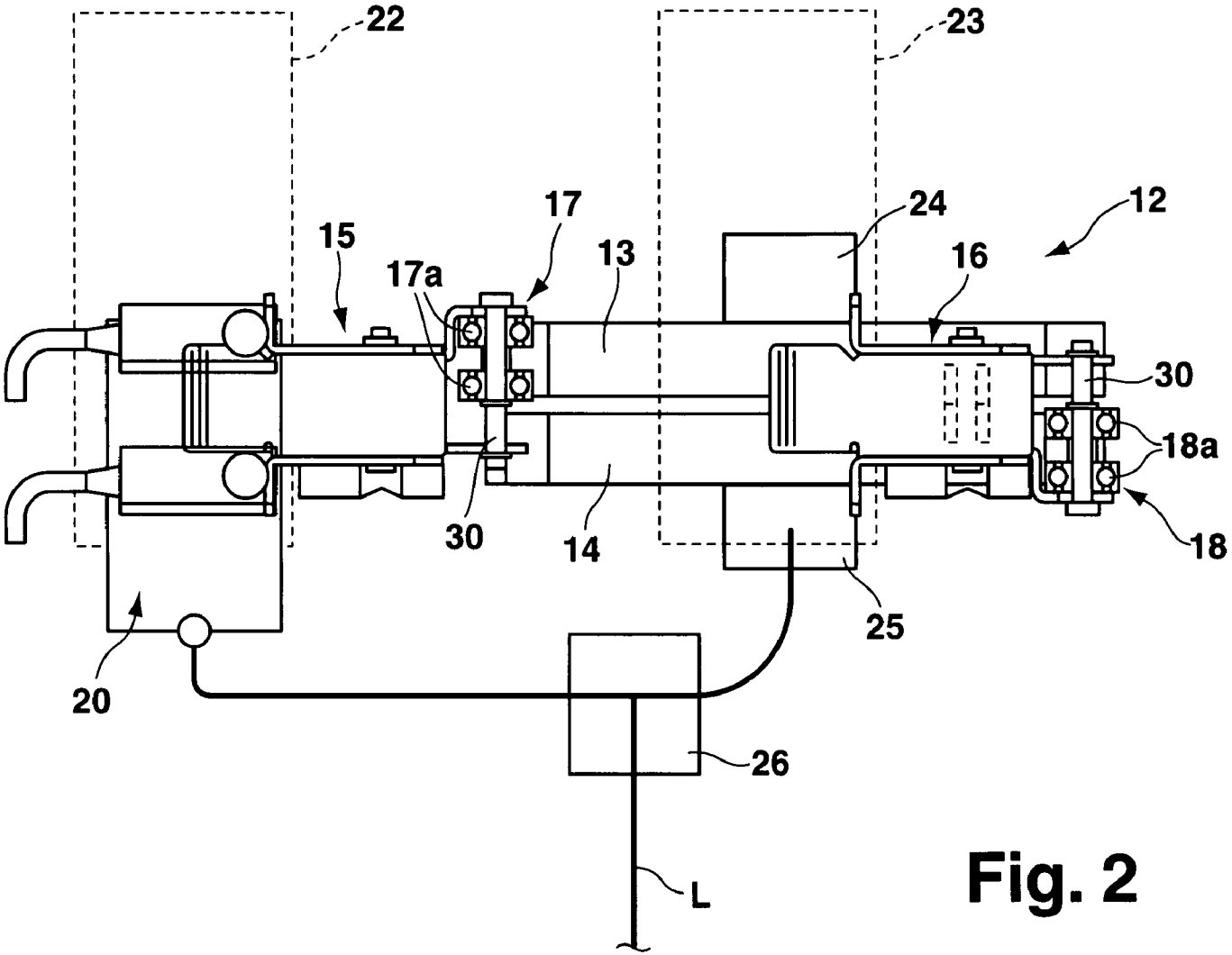
FIG. 2 shows an enlarged representation of an opening unit.

In the embodiment shown, the stop part 17 of the first holder 15 abuts against the first stop 13 via the rollers 17*a* when the first stop is in its operative position. The tong-like holder 15 is opened through abutment of the stop part 17 on the first stop 13 such that the leaflet is carried along by the product P during its insertion motion and can be inserted into the package V. The tong-like holder 15 may be open for a relatively long time, since the next holder to be opened has another structure and cooperates with the other stop. FIG. 2 shows that the stop part 18 of the tong-like holder 16 is still in abutment with the associated stop 14 when the stop part 17 of the next tong-like holder 15 is already in abutment with the other stop 13.

When the first detector device 19 determines that the product P is not inserted, this means that not all conditions are met which are required for proper transfer of the product. The corresponding insertion signal provides indication to the control device 26 that the stop which is associated with the next tong-like holder is to be brought into the inoperative position to ensure that the holder does not abut against the stop and is correspondingly not opened. The leaflet remains in the tong-like holder and is removed and discharged at another location of the leaflet tong chain.

What is claimed is:

1. A packaging machine for inserting a product and a leaflet into a package, the machine comprising:

a transfer device cooperating with the product to insert the product into the package;

a circulating leaflet supply device;

first holders structured to grasp and hold one leaflet each, said first holders mounted to and moving along with said circulating leaflet supply device to dispose a leaflet between the product and the package in a region of said transfer device in such a manner that the leaflet can be inserted together with the product into the package;

second holders structured to grasp and hold one leaflet each, said second holders mounted to and moving along with said circulating leaflet supply device to dispose a leaflet between the product and the package in a region of said transfer device in such a manner that the leaflet can be inserted together with the product into the package, each of said second holders neighboring one of said first holders on at least one side thereof;

a first stop cooperating with said first holders to release the leaflet;

means for actuating said first stop to move said first stop into an operative position disposed in a transport path of said first holders and into an inoperative position in which said first stop is removed from cooperation with said first holders;

a second stop cooperating with said second holders to release the leaflet; and means for actuating said second stop to move said second stop into an operative position disposed in a transport path of said second holders and into an inoperative position in which said second stop is removed from cooperation with said second holders.

2. The packaging machine of claim 1, further comprising third holders structured to grasp and hold one leaflet each, said third holders mounted to and moving along with said circulating leaflet supply device to dispose a leaflet between the product and the package in a region of said transfer device in such a manner that the leaflet can be inserted together with the product into the package and also further comprising a third stop cooperating with said third holders to release the leaflet.

3. The packaging machine of claim 1, wherein said first stop and said second stop have a strip-shape and are disposed one above an other.

4. The packaging machine of claim 1, wherein said first stop actuating means comprises a first spring pretensioning said first stop into said inoperative position, said first stop actuating means moving said first stop into said operative position against pretension of said first spring, and wherein said second stop actuating means comprises a second spring pretensioning said second stop into said inoperative position, said second stop actuating means moving said second stop into said operative position against pretension of said second spring.

5. The packaging machine of claim 1, wherein each of said first holders comprises a first stop part for cooperation with said first stop and each of said second holders comprises a second stop part for cooperation with said second stop.

6. The packaging machine of claim 5, wherein said first stop part comprises at least one first roller which rolls on said first stop and said second stop part comprises at least one second roller which rolls on said second stop.

7. The packaging machine of claim 1, further comprising a first detector device for sensing an insertion motion of the product into the package and for issuing a corresponding insertion signal to a control device.

8. The packaging machine of claim 7, further comprising a second detector device which detects a position and structure of a next holder to be opened and which issues a corresponding holder signal to said control device.

9. The packaging machine of claim 8, wherein stops can be brought into operative positions in dependence on said insertion signal and said holder signal.

10. The packaging machine of claim 9, wherein said first detector device, said second detector device, said first stop, said second stop, said first stop actuating means, and said second stop actuating means can be adjusted as a unit in a transport direction of said leaflet supply device.

* * * * *